United States Patent [19]

Findlay

[11] Patent Number: 5,067,266

[45] Date of Patent: Nov. 26, 1991

[54] HAMMER SAFETY MECHANISM

[75] Inventor: David Findlay, Guilford, Conn.

[73] Assignee: Guilford Engineering Associates, Inc., Guilford, Conn.

[21] Appl. No.: 595,189

[22] Filed: Oct. 10, 1990

[51] Int. Cl.[5] ..... F41A 17/48; F41A 17/76

[52] U.S. Cl. ..... 42/70.08; 42/70.06

[58] Field of Search ..... 42/70.08, 66, 70.06

[56] References Cited

U.S. PATENT DOCUMENTS

| | | | |
|---|---|---|---|
| 132,222 | 10/1872 | Von Martini | 42/70.06 |
| 2,465,699 | 3/1949 | Smith | 42/70.06 |
| 3,605,312 | 9/1971 | Domain | 42/70.06 |
| 4,316,341 | 2/1982 | Landry | 42/70.08 |
| 4,352,317 | 10/1982 | Wilhelm | 42/70.08 |
| 4,400,901 | 8/1983 | Hillberg | 42/70.08 |
| 4,962,606 | 10/1990 | Pozzi | 42/70.08 |

*Primary Examiner*—Michael J. Carone

*Attorney, Agent, or Firm*—McCormick, Paulding & Huber

[57] ABSTRACT

A lever action rifle having a breech bolt, an exposed hammer moveable between cocked and striking positions, an operating lever supported for movement between inactive and cocking and loading position for opening and closing the breech bolt and moving the hammer to cocked position, and a trigger moveable from a ready position to a firing position to release the hammer from cocked position to move to striking position includes a hammer blocking mechanism which allows the hammer to attain its striking position only in response to proper operation of the trigger. A trigger latching mechanism secures the trigger in its ready position when the operating lever is moved from its inactive position and also functions to releasably retain the operating lever in its inactive position.

21 Claims, 7 Drawing Sheets

HAMMER SAFETY MECHANISM

BACKGROUND OF THE INVENTION

This invention relates in general to an improved hammer safety mechanism for a firearm and deals more particularly with an improved hammer safety mechanism for a firearm which includes an externally exposed hammer.

In a firearm of the general type with which the present invention is concerned a hammer, held in cocked position against the biasing force of a spring, remains in cocked position until a trigger, which comprises part of the firing mechanism, is operated to release the hammer, allowing it to move to striking position to discharge the firearm.

A manually activated safety device is often provided on a lever action firearm of the aforedescribed type to safeguard against accidental discharge when the firearm is unloaded by operating the action and to otherwise prevent the hammer from falling prematurely or accidently to discharge the firearm independently of operation of the trigger. Such a safety mechanism may, for example, comprise a cross-pin manually moveable between an off position and a safe or blocking position in the path of travel of the cocked hammer. The cross-pin in its safe position prevents the hammer from moving to its striking position to engage a firing pin or otherwise discharge the firearm. Such a manually activated safety device, when properly employed, will safeguard against firearm discharge resulting from accidental release of the hammer. However, careless individuals often fail to follow the recommendation of the gun manufacturer regarding proper usage of such a manually applied safety device.

It is erroneous to assume that a firearm having an exposed hammer may be safety carried in loaded condition if the firing mechanism is first disabled by manually releasing the hammer from its cocked position. Even a slight blow to the hammer when it is in the latter position, such as may result from dropping the firearm, may be sufficient to cause accidental discharge. The present invention is primarily concerned with the aforedescribed problems particularly as associated with lever action rifles. However, it should be understood that the hammer safety mechanism of the present invention may find application in firearms of other types.

SUMMARY OF THE INVENTION

In accordance with the present invention an improved hammer safety mechanism is provided for a firearm having a hammer supported for movement between cocked and striking positions, biasing means for urging the hammer toward its striking position, and trigger mechanism including a trigger supported for movement between ready and firing positions. The trigger mechanism is operative to hold the hammer in its cocked position when the trigger is in its ready position and to release the hammer from its cocked position in response to movement of the trigger to its firing position. The improved hammer safety mechanism includes a hammer block supported for movement between a hammer blocking position wherein it is disposed in the path of hammer movement toward its striking position and a hammer releasing position wherein it is out of the path of movement of the hammer to its striking position, connecting means for moving the hammer block to its hammer releasing in response to movement of said hammer to its cocked position and retaining said hammer block in its hammer releasing position while said hammer remains in said cocked position, enabling means for moving said hammer block to its hammer blocking position in response to release of said hammer from its cocking position while said trigger is in its ready position and retaining said hammer block in its hammer blocking position to prevent said hammer from attaining its striking position, and disabling means for releasably securing the hammer block in its hammer releasing position in response to movement of the trigger to its firing position when the hammer is in its cocked position to permit the hammer to move to its striking position.

DETAILED DESCRIPTION OF PREFERRED EMBODIMENTS AND METHODS

Figure 1:
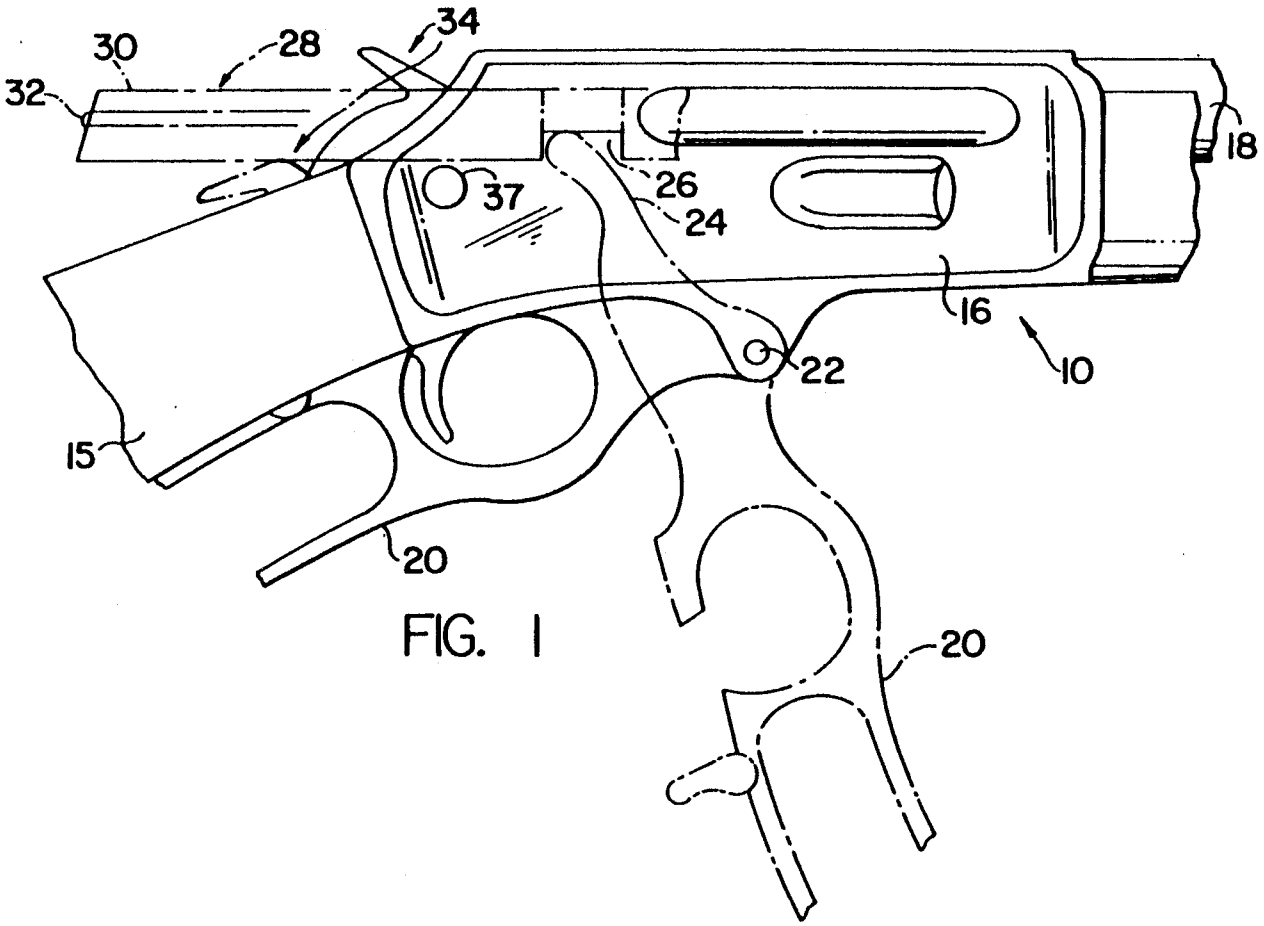
FIG. 1 is a fragmentary side elevational view of a typical lever-action rifle having an externally exposed hammer and a hammer safety mechanism embodying the present invention.

In the drawings, a hammer safety mechanism embodying the present invention is illustrated and described with reference to a typical lever-action rifle indicated generally by the reference numeral 10 and shown in FIG. 1. The hammer safety mechanism is indicated generally at 12 in FIGS. 2 and 6–8, where the firing mechanism of the rifle 10 is designated generally at 14.

Further referring to FIG. 1, the illustrated rifle 10 has a stock 15, a receiver 16 and a barrel 18 which projects in a forward direction from the receiver and defines a cartridge chamber (not shown) which opens into the receiver. A finger or operating lever 20 is supported on the underside of the receiver 16 by a pivot pin 22 for pivotal movement between an inactive or full line position and a cocking and loading position indicated by broken lines. In its inactive position the operating lever rests along the underside of the receiver and extends rearwardly along the stock 15. A bolt-reciprocating arm 24, which forms an integral part of the operaring lever 20, extends forwardly and upwardly beyond the lever pivot pin 22 when the operating lever is in its inactive position. The bolt reciprocating arm 24 has a forward or free end portion for engagement within a recess 26 in a breech bolt assembly, indicated generally at 28 and slidably supported within the receiver 16 for movement between open and closed positions relative to the chamber.

The breech bolt assembly 28 comprises an axially elongated generally cylindrical bolt member 30 which carries a conventional firing pin 32. When the operating lever 20 is pivoted in a counterclockwise direction from its full line to its broken line position of FIG. 1 the bolt reciprocating arm 24 enters the recess 26 and engages the bolt member 30 to move it from its closed to its open or retracted position of FIG. 1, in which it appears in broken lines. An externally exposed hammer, indicated generally at 34 and pivotally supported on the receiver by a hammer pivot pin 36, has a striking surface 31 and includes a projection 33 and a cam surface 35 terminating at the projection. The hammer is disposed in the path of rearward movement of the breech bolt assembly 28 and is cocked by movement of the breech bolt assembly to its retracted position, as shown in FIG. 1 and as will be hereinafter more fully discussed.

Figure 2:
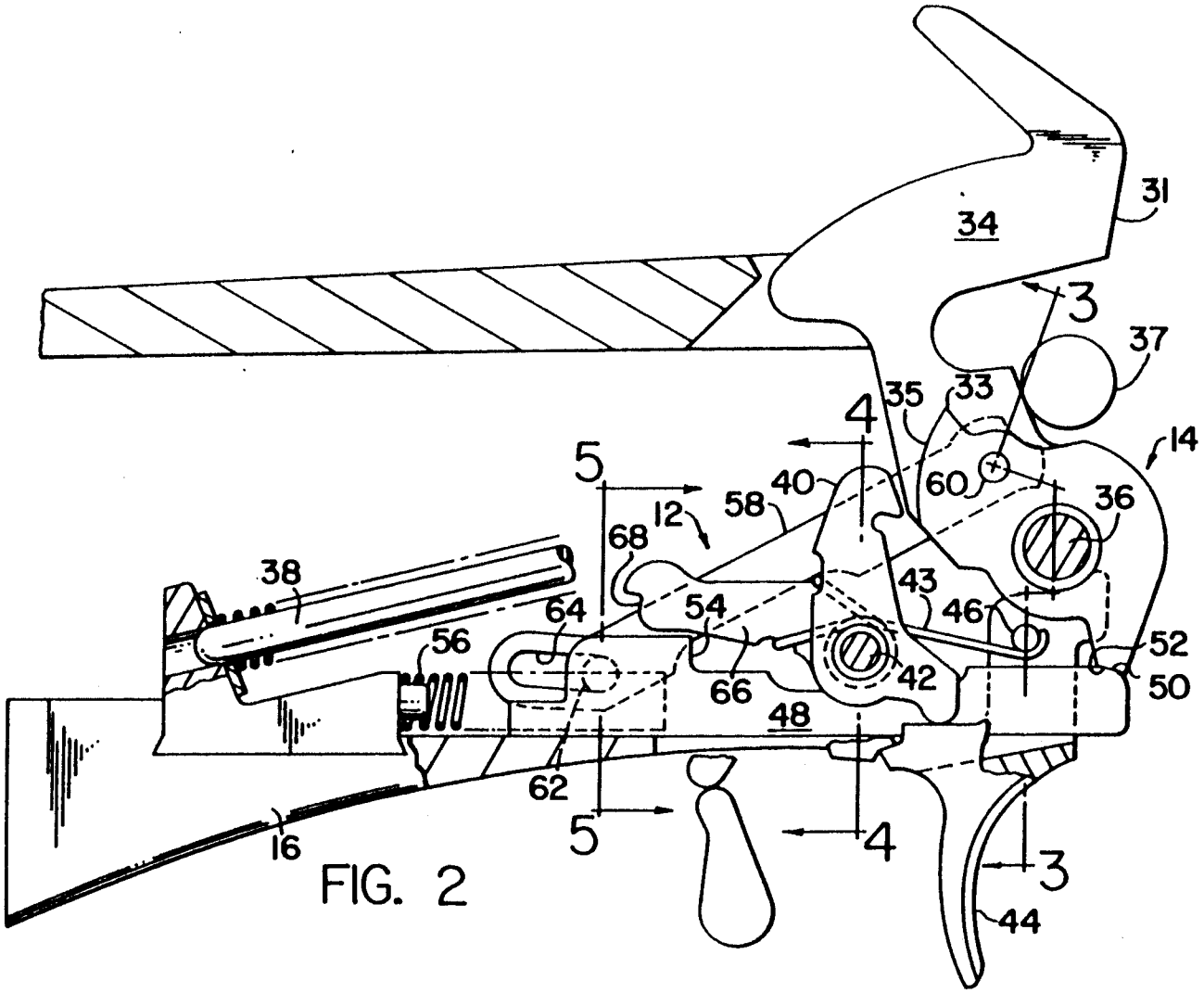
FIG. 2 is a fragmentary longitudinal sectional view through the rifle of FIG. 1 and shows the firing mechanism and the hammer safety mechanism of the rifle, the hammer being shown blocked in a safe position by a cross-pin safety device.
Figure 5:
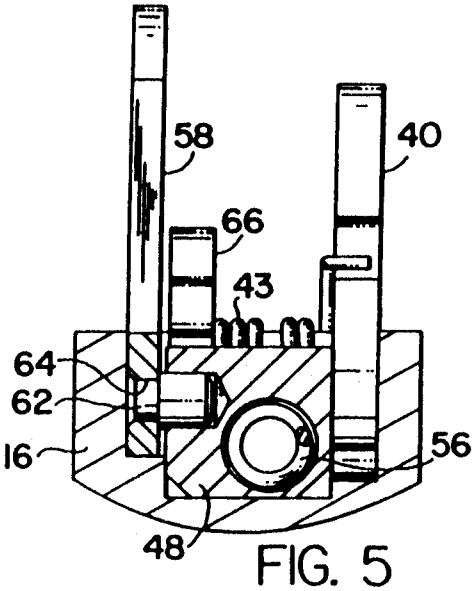
FIG. 5 is a somewhat enlarge fragmentary sectional view taken along the line 5—5 of FIG. 2.
Figure 4:
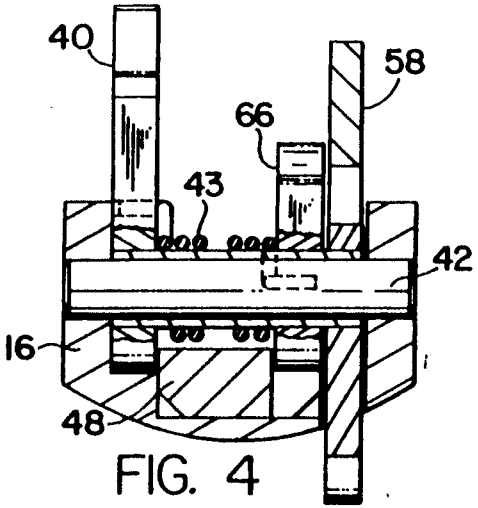
FIG. 4 is a somewhat enlarged fragmentary sectional view taken along the line 4—4 of FIG. 2.

Referring to FIG. 2, the hammer 34 is shown in a safety position, being held in the latter position by a manually activated cross-pin safety 37 of a well known type supported on the receiver 16 for lateral movement between off and safe positions. A hammer spring and strut assembly 38 of conventional type, shown in FIG. 2, acts between the hammer 34 and the receiver 16 to urge the hammer in clockwise direction from its cocked position of FIG. 6 toward its striking position shown in FIG. 8, wherein it engages an exposed end of the firing pin 32 at the rear end of the bolt member 30. The hammer 34 is retained in its cocked position of FIG. 6 by a sear 40 pivotally supported on the receiver by a sear pivot pin 42 and urged in a clockwise direction toward the hammer 34 and to a holding position by one end portion of a double torsion spring 43 which performs a further function to be hereinafter described.

Figure 6:
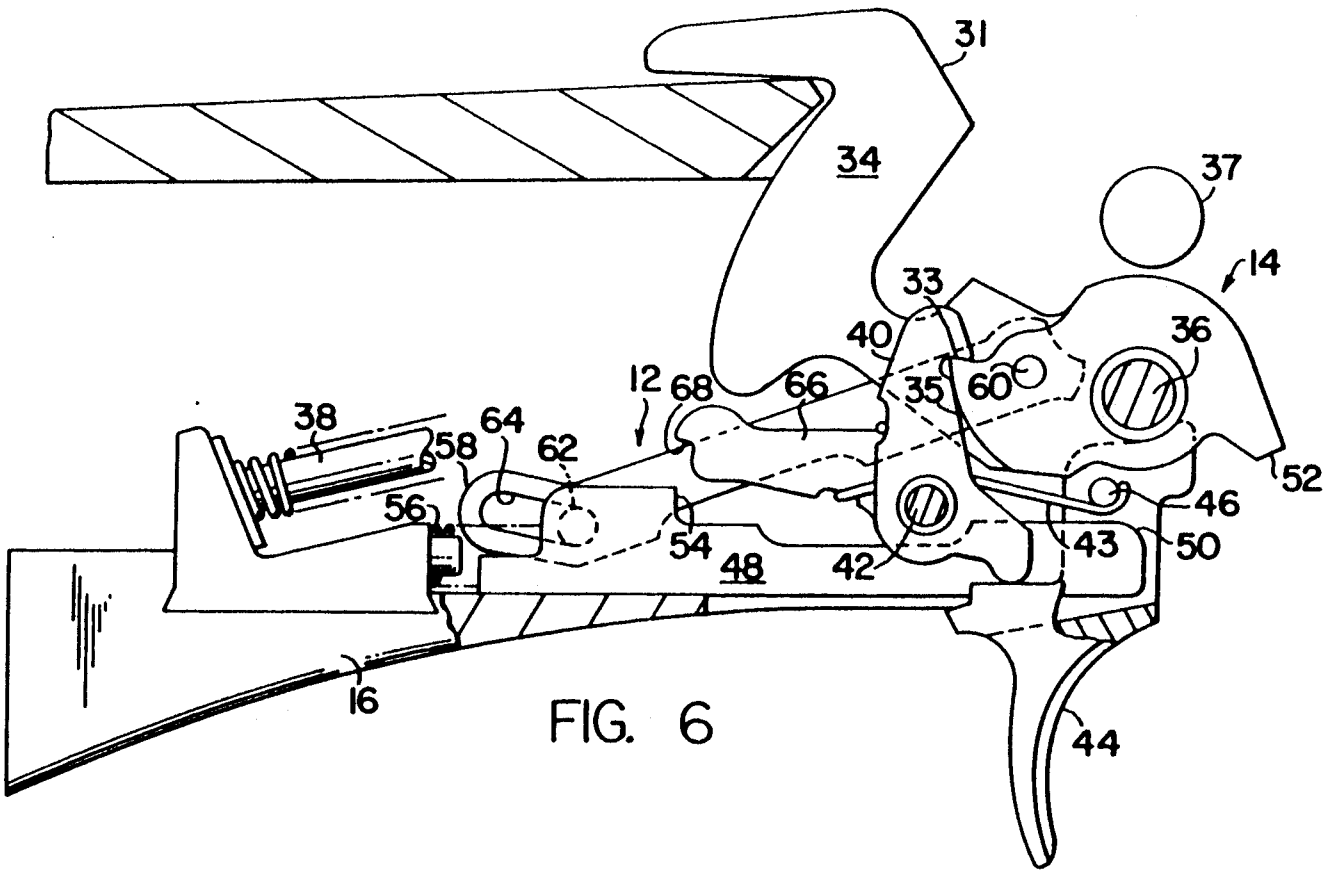
FIG. 6 is similar to FIG. 2 but shows the firing mechanism in cocked position.

The nose of the sear is biased toward the cam surface 35 and snaps into holding engagement with the projection 33 on the hammer to hold the hammer in its cocked position when the hammer is rotated in counterclockwise direction to its cocked position of FIG. 6 by rearward movement of the breech bolt assembly 28 in response to operation of the operating lever 20 in a manner well known in the firearm art.

Figure 8:
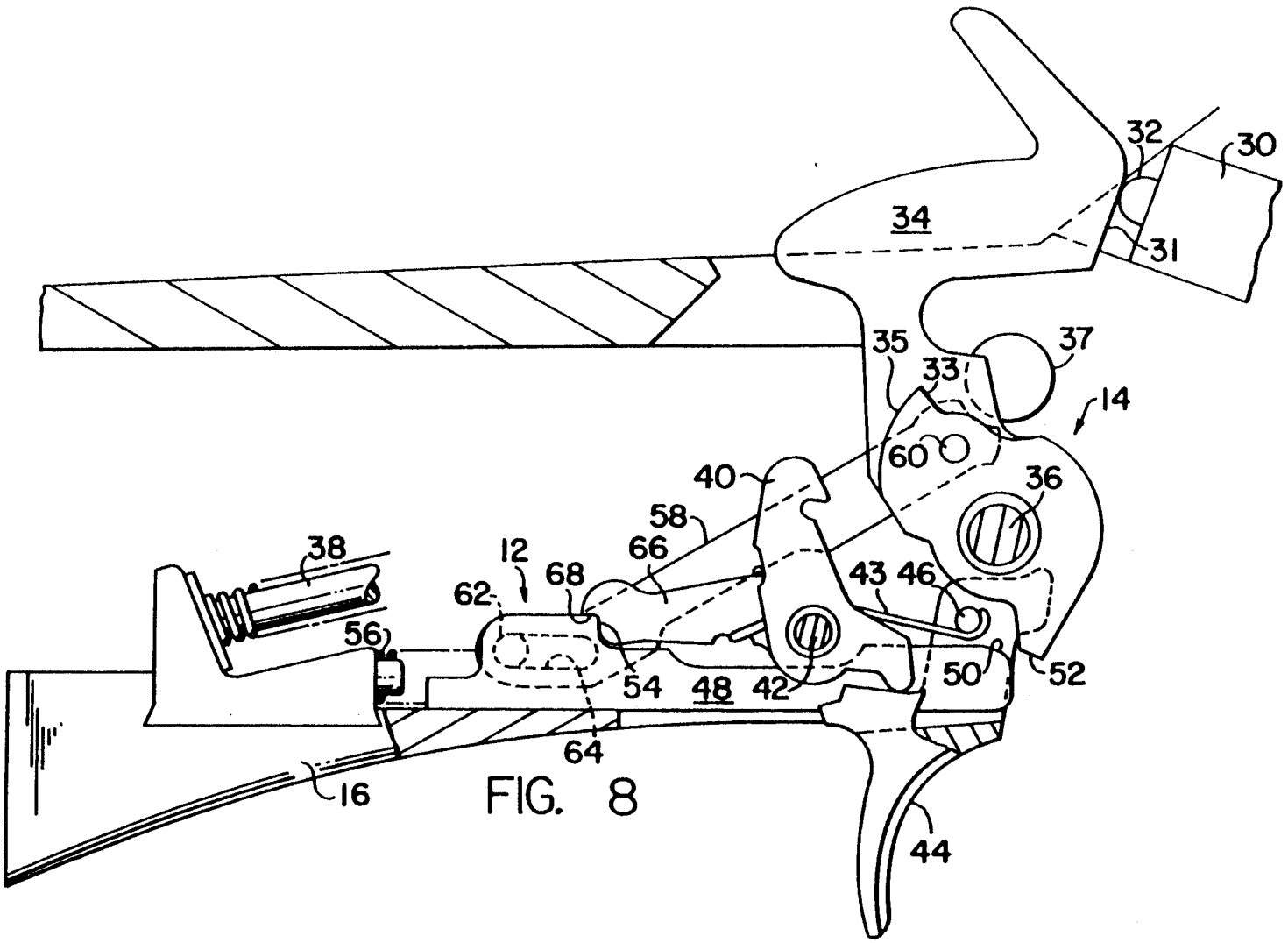
FIG. 8 is similar to FIG. 2 but shows the firing mechanism in firing position.

The rifle 10 is fired by operating a trigger 44 pivotally supported on the receiver 16 by a trigger pivot pin 46 for movement between a ready position shown in FIG. 6 and a firing position shown in FIG. 8. Movement of the trigger from its ready position to its firing position causes a corresponding counterclockwise movement of the sear 40 about the sear pivot pin 42 and to a hammer releasing position wherein the hammer 34 is released to move from its cocked position to its striking or firing position in response to biasing force exerted upon it by the hammer spring and strut assembly 38, all of which is well known in the art.

Figure 7:
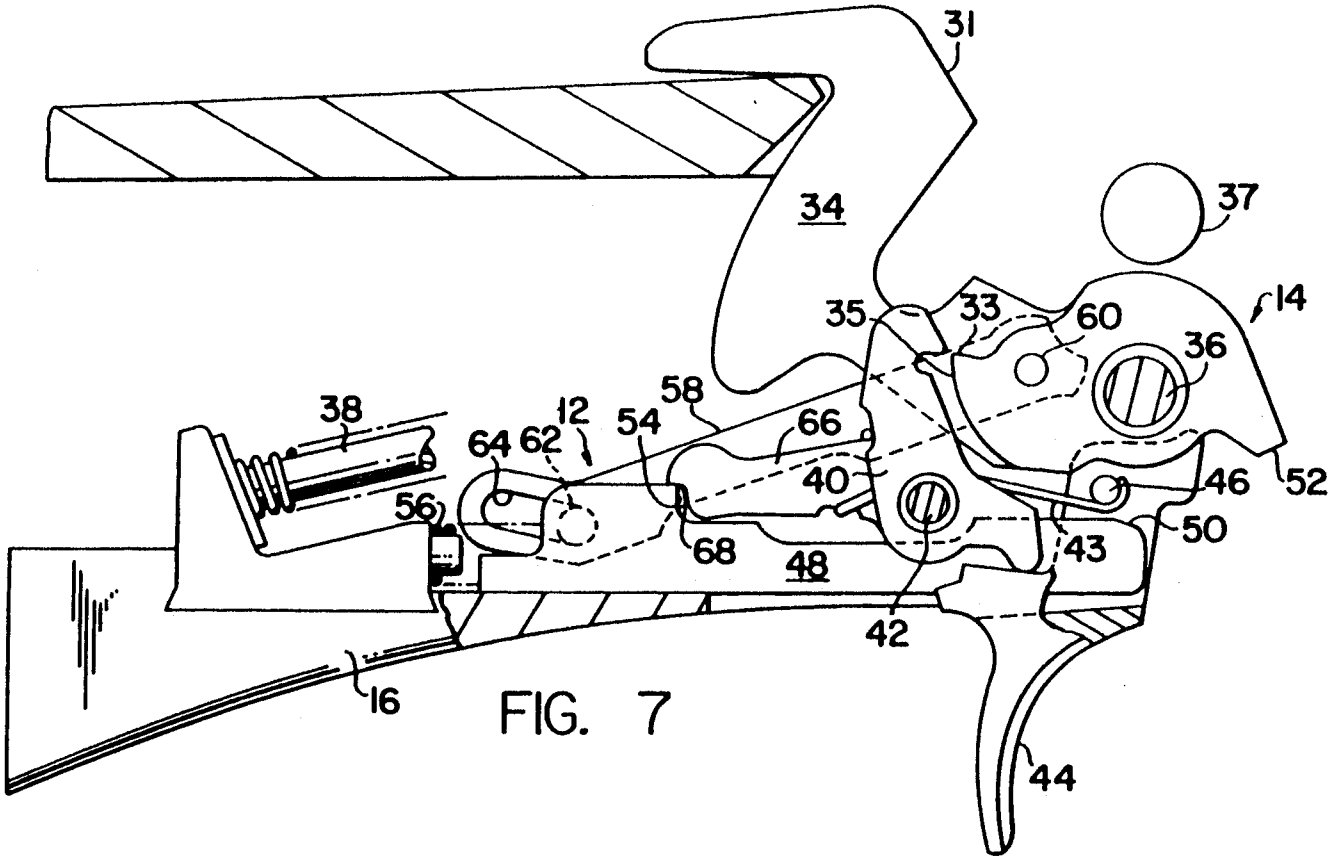
FIG. 7 is similar to FIG. 2 but shows the firing mechanism at the instant of hammer release.

Considering now the hammer safety mechanism 12 in further detail, the latter mechanism includes a hammer block indicated generally at 48 and supported by the receiver 16 for rectilinear reciprocal sliding movement between hammer blocking position shown in FIG. 2 and hammer releasing position shown in FIGS. 6–8, as will hereinafter further discussed.

An abutment surface 50 at the forward end of the hammer block 48 is co-engageable with an associated bearing surface 52 on the hammer when the hammer blocking member is in its hammer blocking position. The hammer block 48 also has an upwardly open recess therein partially defined by a forwardly facing abutment surface 54, for a purpose which will be hereinafter evident. A biasing spring 56, shown in FIG. 2, acts between the receiver 16 and the hammer block 48 to urge the hammer block in a forward direction from its hammer releasing position to its hammer blocking position.

Movement of the hammer block 48 from its hammer blocking position (FIG. 2) to its hammer releasing position is effected by link or hammer block strut 58 pivotally connected at one end to the hammer 34 by a pivot pin 60. The hammer block 48 is connected to the hammer block strut 58 for movement with the hammer block strut and relative to it by a pin and slot connection which includes a pin 62 mounted in fixed position on the hammer block 48 and received within a slot 64 in the rear end portion of the hammer block strut 58.

The hammer safety mechanism 12 further includes a hammer block catch 66 supported for independent pivotal movement by the sear pivot pin 42 and biased in clockwise direction by the other end portion of the double torsion spring 44. The hammer block catch 66 is supported for pivotal movement between a disabling position wherein it is disposed in the path of movement of the hammer block and an inactive position wherein it is out of the path of movement of the hammer block. The hammer block catch has a rearwardly facing abutment surface 68 for engaging the forwardly facing abutment surface 54 on the hammer block 48 in disabling position to disable the hammer block or maintaining it in its hammer releasing position so that the rifle 10 may be fired by proper operation of the trigger 44, as will be hereinafter further evident.

The hammer safety mechanism 12 maintains the hammer in a safe position with the hammer striking surface, indicated at 31, in spaced relation to the firing pin 32 except when the hammer is in its cocked position and the rifle 10 is ready to be fired. In FIG. 2 the hammer 34 is shown held in a safe position by the hammer block 48. The hammer is further secured in safe position by the cross-pin 37, which is shown in its "on" or safe position. The trigger is in its forward or ready position and the hammer block catch is in its hammer releasing position. The hammer block 48 is biased to its forward or hammer blocking position by the hammer block spring 56 and the bearing surface 50 on the hammer is engaged with the abutment surface 52 on the forward end of the hammer slide. Thus, the hammer is blocked in a position wherein its striking surface 31 is spaced from the firing pin 30. The co-engaging surfaces 50 and 52 on the hammer 34 and the hammer block 48 member prevent the hammer from pivoting in a clockwise direction about the hammer pivot pin 36 and to striking position.

Movement of the operating lever 20 to open the bolt assembly 28 and load the firearm causes the rearwardly moving bolt assembly 28 to engage the hammer 34 and pivot it in counterclockwise direction from its position of FIG. 2 to its cocked position of FIG. 6. The cam surface 35 on the rotating hammer engages the nose of the sear 40 and cams the sear in counterclockwise direction from its position of FIG. 2. When the hammer reaches its cocked position of FIG. 6 the sear 40, urged by the spring 44, pivots in clockwise direction into holding engagement with the projection 33 on the hammer to maintain the hammer in its cocked position against the biasing force of the hammer strut and spring assembly 38. Rotation of the hammer 34 in a counterclockwise direction from its position of FIG. 2 to its cocked position of FIG. 6 causes a corresponding rearward movement of the hammer block strut 58 which moves the hammer block 48 rearward to its hammer releasing position of FIG. 6. The firing mechanism is now in a ready position. The firearm may be discharged by manually moving the cross-pin 37 laterally of the receiver 16 to its "off" position of FIGS. 6–8 and thereafter operating the trigger 44.

Figure 3:
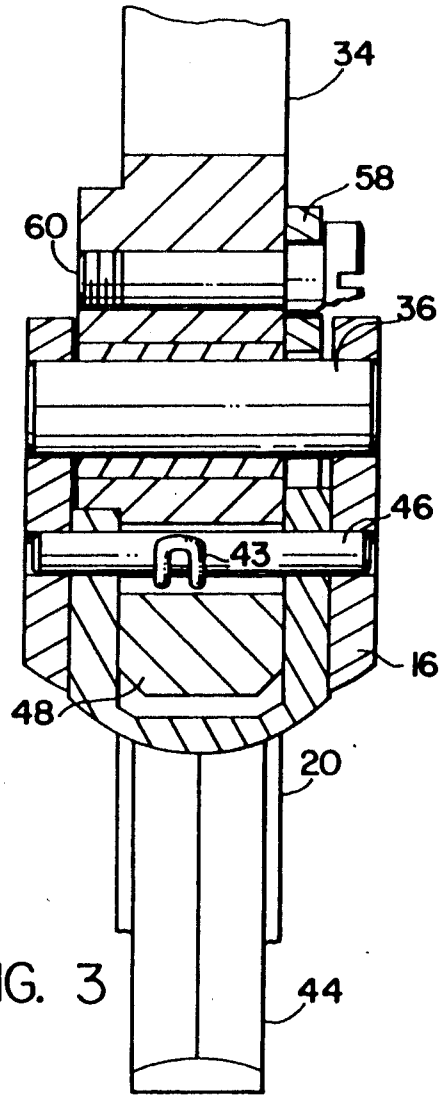
FIG. 3 is a somewhat enlarged fragmentary sectional view taken generally along the line 3—3 of FIG. 2.

Pivotal movement of the trigger from its ready position of FIG. 3 to its firing position (FIG. 7) causes simultaneous counterclockwise pivotal movement of the sear 40 and the hammer block catch against the action of the spring 43. However, before the sear 40 attains its hammer releasing position of FIG. 7 the abutment surface 68 on the hammer block catch moves into alignment with the abutment surface 54 on the hammer block. At the instant of sear release, shown in FIG. 7, the abutment surface 58 on the hammer block is disposed slightly rearward of the abutment surface 68 on the hammer block catch, the hammer block being held in the latter position by the hammer block strut 58. Upon release of the sear 40, the hammer 34 rotates in clockwise direction about the hammer pivot pin 36 and to its striking position of FIG. 8 thereby moving the hammer block strut to its position of FIG. 8. Even if the trigger 44 is immediately released from its firing position the hammer block catch 66 will retain the hammer block 48 in its disabled position for a sufficient time to allow the hammer 34 to strike the firing pin thereby discharging the firearm.

When the trigger 44 is released the sear 40 is biased in clockwise direction by the double torsion spring 44 and toward its holding position of FIG. 6. The hammer block catch 66 is also biased in clockwise direction by the spring 43 and to hammer block releasing position out of holding alignment with the hammer block 48. Since the hammer block strut 58 is now in its forward most position the pin 62 is free to travel in a forward direction within the slot 64 which allows the hammer block to be biased toward its forward or safety position by the hammer block spring 56.

The inertial force of the hammer and the resilience of the hammer and firing pin may be sufficient to cause slight hammer rebound which aids in positioning the hammer block under the hammer and in its safety position of FIG. 2. Since the hammer has reached its striking position the force exerted on the hammer by the hammer strut spring assembly 38 is minimal. The moment of force exerted upon the hammer 34 by the coengaging cam surfaces 50 and 52 is sufficient to overcome the force exerted upon the hammer by the hammer strut spring assembly causing the hammer to pivot in counterclockwise direction about the hammer pivot pin 36 and to its safe position of FIG. 2.

As in most firearms of this type, when the firearm 10 is cocked with a round in the chamber, the hammer may be released from its cocked position and manually lowered toward its firing position by releasing the trigger while the hammer is under manual control. However, as the hammer 34 is manually eased toward its striking position the hammer block strut 58 moves with the hammer and toward its forward most position thereby allowing the hammer block to move from its hammer releasing position to its blocking position in the path of the hammer. The hammer block effectively prevents the hammer from engaging the firing pin. If a blow to the hammer is struck, as by dropping the firearm, the hammer cannot transmit force to the firing pin. Thus, the hammer safety mechanism effectively prevents accidental discharge of the firearm under the aforedescribed conditions and allows the firearms to be discharged only in response to proper operation of the trigger.

Figure 9:
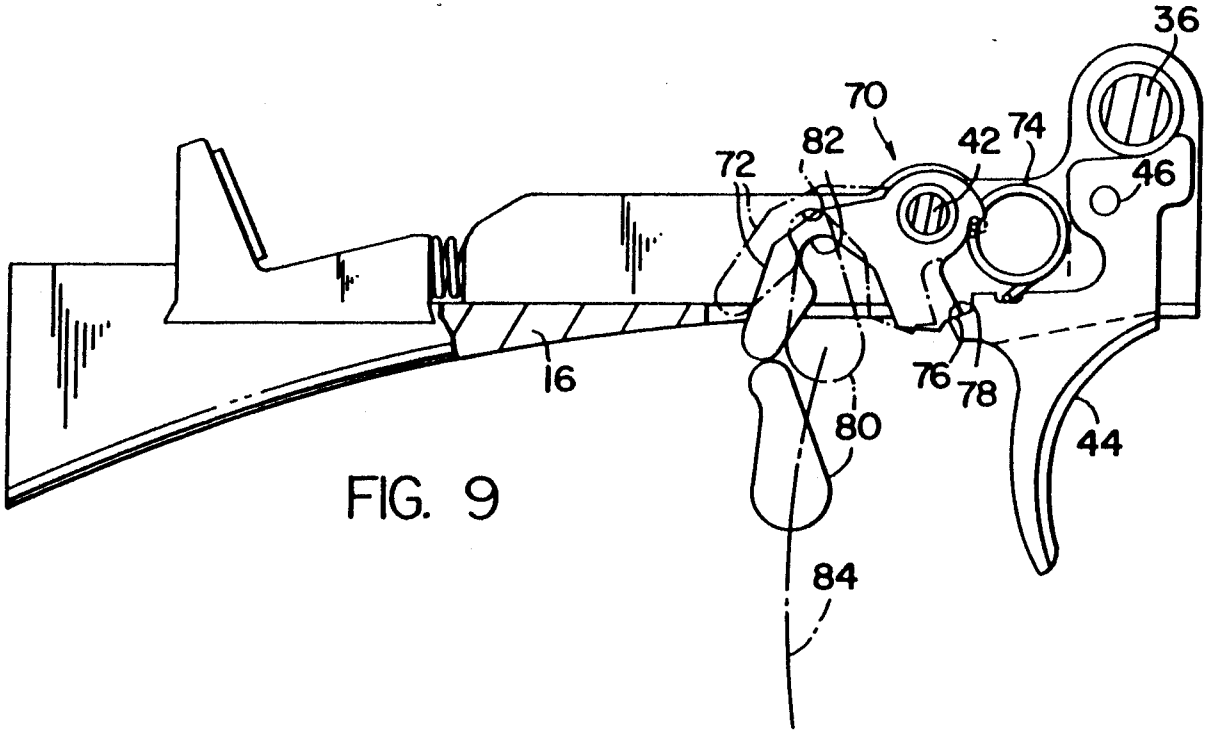
FIG. 9 is similar to FIG. 2 but shows the trigger latching and operating lever detaining mechanism.

Referring now to FIG. 9, the firearm 10 includes a trigger latch and lever detent mechanism, indicated generally at 70, for detaining the operating lever 20 in its inactive position and for latching the trigger 44 in its ready position in response to movement of the operating lever from its inactive position toward its cocking and loading position. The mechanism 70 prevents operation of the trigger to release the hammer 34 from its cocked position while the action is open. The latter mechanism also functions as a detent to releasably retain the operating lever 20 in its inactive position, thereby eliminating the requirement for a separate detent mechanism to perform this function.

The illustrated mechanism 70 includes a latch member 72 pivotally supported on the sear pivot pin 42 for rotation between a trigger latching position shown in full lines and a trigger releasing position indicated by broken lines in FIG. 9. A spring 74 acts between the latch member 72 and the trigger 44 to bias the latch member toward its trigger latching position and to bias the trigger toward its ready position shown in FIG. 9. When the latch member 72 is in its trigger latching position and the trigger 44 is in its ready position an abutment surface 76 on the latch member 72 is disposed in the path of a bearing surface 78 on the trigger. The geometry of the trigger 44 and the latch member 72 are such that the trigger cannot be moved in clockwise direction from its ready position of FIG. 9 when the latch member is in its latching position.

An operating stud 80 carried by the operating lever 20, as shown in FIG. 1, and which may comprise a part of the lever 20, moves the latch member 72 to its trigger releasing position when the operating lever 20 is moved to its inactive or full line position of FIG. 1. More specifically, the operating stud 80 enters a detent recess 82 in the latch member and engages the latch member pivoting it to its broken line or trigger releasing position of FIG. 9. The operating stud 80 travels with the operating lever 20 and along an arcuate path, indicated at 84 in FIG. 9, and is configured to complement an associated portion of the detent recess 82. When the operating lever 20 is in its inactive position the operating stud 80 is disposed within the detent recess 82, as shown in broken lines in FIG. 9. The spring 74 urges the latch member 72 in counterclockwise direction about the pivot pin 42 and into detaining engagement with the operating stud 80 thereby releasably retained the operating lever 20 in its inactive position.

I claim:

1. In a firearm having a hammer supported for movement between cocked and striking positions, biasing means for urging the hammer towards its striking position, and trigger mechanism including a trigger supported for movement between ready and firing positions, the trigger mechanism being operative to hold the hammer in its cocked position when the trigger is in its ready position and to release the hammer from its cocked position in response to movement of the trigger to its firing position, the improvement comprising a hammer block supported for movement between hammer blocking position wherein said hammer block is disposed in the path of hammer movement toward its striking position and hammer releasing position wherein said hammer block is out of the path of movement of the hammer to its striking position, connecting means for moving said hammer block to hammer releasing position in response to movement of said hammer to its cocked position and retaining said hammer block in hammer releasing position while said hammer remains in said cocked position, enabling means for moving said hammer block to hammer blocking position in response to release of said hammer from its cocking position while said trigger is in its ready position and retaining said hammer block in hammer blocking position to prevent said hammer from attaining its striking position, and disabling means for releasably securing said hammer block in hammer releasing position in response to movement of said trigger to its firing position when said hammer is in its cocked position to permit said hammer to move to its striking position.

2. In a firearm as set forth in claim 1 the further improvement wherein said connecting means comprises means for connecting said hammer block to said hammer.

3. In a firearm as set forth in claim 2 the further improvement wherein said connecting means comprises means for connecting said hammer block to said hammer to move with said hammer and to move relative to said hammer.

4. In a firearm as set forth in claim 1 the further improvement wherein said connecting means comprises a hammer block strut pivotally connected to said hammer and connected to said hammer block by a pin and slot connection.

5. In a firearm as set forth in claim 1 the further improvement wherein said enabling means comprises biasing means for urging said hammer block toward its hammer blocking position.

6. In a firearm as set forth in claim 1 the further improvement wherein said disabling means comprises a hammer block catch supported for movement between a disabling position wherein it is disposed in the path of movement of said hammer block to retain the hammer block in its hammer releasing position and an inactive position wherein it is out of the path of movement of said hammer block.

7. In a firearm as set forth in claim 6 the further improvement wherein said hammer block catch is supported for pivotal movement between its disabling and inactive positions.

8. In a firearm as set forth in claim 7 wherein the trigger mechanism includes a sear for retaining the hammer in its cocked position and releasing it from its cocked position in response to movement of the trigger to its firing position the further improvement wherein said hammer block catch and said sear are supported for simultaneous pivotal movement about a common axis in response to movement of the trigger to its firing position.

9. In a firearm as set forth in claim 8 wherein said sear is supported for movement between hammer holding and hammer releasing positions, the further improvement comprising means for biasing said sear toward said holding position and means for biasing said hammer block catch to its inactive position.

10. In a firearm as set forth in claim 9 the further improvement wherein said means for biasing said sear comprises said means for biasing said hammer catch.

11. In a firearm as set forth in claim 1 including a receiver the further improvement wherein said hammer block is supported for rectilinear reciprocal movement within the receiver.

12. In a lever action rifle having a receiver, a breech bolt supported by the receiver for reciprocal movement between open and closed positions, an operating lever supported by the receiver for movement between an inactive position and a cocking and loading position to move the breech bolt between its closed and opened positions, firing mechanism supported within the receiver and including a hammer supported for pivotal movement between cocked and striking positions and having a part thereof exposed externally of the receiver and in the path of movement of the breech bolt toward its open position, first biasing means for urging the hammer toward its striking position, a sear supported for pivotal movement between hammer holding and hammer releasing position, the sear in its holding position being operative to releasably retain the hammer in its cocked position, and a trigger supported for movement between ready and firing positions, the sear being moveable from its hammer holding position to its hammer releasing position in response to movement of the trigger from its ready to its firing position, the improvement comprising a hammer block supported in the receiver for reciprocal movement between hammer blocking position wherein the hammer block is disposed in the path of hammer movement toward said striking position and hammer releasing position wherein said hammer block is out of the path of hammer movement, means connecting said hammer block to said hammer to move with said hammer and to its hammer releasing position in response to movement of said hammer to its cocked position and to permit said hammer to move from its cocked position to its striking position while said hammer block remains in its hammer releasing position, hammer block disabling means for releasably securing said hammer block in its hammer releasing position in response to movement of said trigger to it firing position when said hammer is in its cocked position, and enabling means for moving said hammer block to its hammer blocking position when said hammer is released from its cocked position while said trigger is in its ready position to prevent said hammer from attaining its striking position and maintaining said hammer block in its blocking position until it is returned to its hammer releasing position by movement of said hammer to its cocked position.

13. In a lever action rifle as set forth in claim 12 the further improvement wherein said hammer block is supported for rectilinear reciprocal movement within said receiver.

14. In a lever action rifle as set forth in claim 12 wherein said hammer block disabling means comprises a hammer block catch supported for pivotal movement relative to said hammer block.

15. In a lever action rifle as set forth in claim 14 the further improvement wherein said hammer block catch and said sear are supported for pivotal movement about a common axis.

16. In a lever action rifle as set forth in claim 12 the further improvement wherein said enabling means comprises a spring acting between said receiver and said hammer block.

17. In a lever action rifle as set forth in claim 12 the further improvement comprising trigger latching means for securing said trigger in its ready position in response to movement of said operating lever from its inactive position toward its cocking and loading position and maintaining said trigger in its ready position until said operating lever is returned to its inactive position.

18. In a lever action rifle as set forth in claim 17 the further improvement wherein said means for trigger latching means comprises detent means for releasably securing said operating lever in its inactive position.

19. In a lever action rifle as set forth in claim 17 the further improvement wherein said trigger latching means comprises a trigger latching member supported for movement between trigger securing and trigger releasing position, biasing means for urging said trigger latching member toward its trigger securing position, and an operating stud carried by said operating lever for moving said trigger latching member to said trigger releasing position in response to movement of said operating lever to its inactive position and maintaining said trigger latching member in its trigger releasing position while said operating lever is in its inactive position.

20. In a lever action rifle as set forth in claim 19 the further improvement wherein said operating stud cooperates with said trigger latching member when said operating lever is in its inactive position to releasably retain said operating lever in its inactive position.

21. In a lever action rifle having a receiver, a breech bolt supported by the receiver for movement between closed and open position, an operating lever supported on the receiver for movement between an inactive position corresponding to the closed position of the breech bolt and a cocking and loading position corresponding to an open position of the breech bolt, a hammer supported by the receiver for movement between cocking and striking positions, said hammer having a part thereof exposed in the path of movement of the breech bolt between its closed an open positions, said hammer being moveable to its cocked position in response to movement of the breech bolt to its open position, a trigger mechanism including a trigger supported for movement between ready and firing position, said trigger being operable upon movement from its ready to its firing position to release said hammer from its cocked position for movement to its striking position, and trigger latching means for securing said trigger in its ready position in response to movement of said operating lever from its inactive position toward its cocking and loading position and for maintaining said trigger in its ready position while said operating lever is out of its inactive position, the improvement comprising said trigger latching means comprising means to releasably retaining said operating lever in its inactive position.

* * * * *